US005258061A

United States Patent [19]

Martyak et al.

[11] Patent Number: 5,258,061

[45] Date of Patent: Nov. 2, 1993

[54] ELECTROLESS NICKEL PLATING BATHS

[75] Inventors: Nicholas M. Martyak, Ballwin; Bruce F. Monzyk, Maryland Heights; Henry H. Chien, St. Louis, all of Mo.

[73] Assignee: Monsanto Company, St. Louis, Mo.

[21] Appl. No.: 979,100

[22] Filed: Nov. 20, 1992

[51] Int. Cl.[5] ..... C23C 18/34; C23C 18/36

[52] U.S. Cl. ..... 106/122; 106/127

[58] Field of Search ..... 106/1.22, 1.27

[56] References Cited

U.S. PATENT DOCUMENTS

| | | | |
|---|---|---|---|
| 3,686,020 | 8/1972 | Coll-Palagos | 106/1.27 |
| 3,876,434 | 4/1975 | Dutkewych et al. | 106/1.27 |
| 3,953,624 | 4/1976 | Arnold | 106/1.27 |
| 4,407,869 | 10/1983 | Mallory et al. | 106/1.22 |
| 4,483,711 | 11/1984 | Harbulak et al. | 106/1.22 |
| 4,600,609 | 7/1986 | Leever et al. | 106/1.26 |

*Primary Examiner*—Helene Klemanski

*Attorney, Agent, or Firm*—Thomas E. Kelley; Mark F. Wachter

[57] ABSTRACT

Aqueous electroless nickel plating solutions comprising a water soluble nickel salt associated with a neutral zwitterion, e.g. alanine or glycine, and/or monovalent anion, e.g. lactate, nitrate, hypophosphite, acetate, sulfamate, hydrochloride, formate, propionate, trichloroacetate, trifluoroacetate, methanesulfonate, glycolate, aspartate or pyruvate, as counterion and chelant, a neutral, e.g. borate, or monovalent, e.g. hypophosphite, reducing agent, and a non-thiourea stabilizer, e.g. protonated dimethylamine or dimethylaminopropylamine or 2-hydroxyethanesulfonic acid. Valuable components of spent baths, e.g. nickel and neutral or monovalent anion species, can be advantageously recycled by employing solvent extraction and anion filtration operations.

13 Claims, No Drawings

ELECTROLESS NICKEL PLATING BATHS

Disclosed herein are nickel plating baths and methods of making and using such baths.

BACKGROUND OF THE INVENTION

Electroless plating baths typically comprise a metal salt, a chelant for the metal species, a reducing agent for the metal and stabilizers to retard the tendency of the reducing agent to promote reduction and deposition of the metal, e.g. on indiscriminate surfaces or in the bulk solution. In nickel electroless plating baths of the prior art, the nickel salt is of a divalent anion such as sulfate. It has been discovered that sulfate ions create problems in treating spent electroless nickel plating baths. For instance, not only are sulfate ions not environmentally acceptable in many effluent streams, but sulfate ions are difficult to separate from desirable polyvalent anions such as chelant species.

Because of the difficulties in treating spent plating baths, disposal in landfills is often a method of choice for disposing of spent plating solutions or metal sludge precipitate from plating baths. Typically sulfate is removed from plating solutions by lime treatment forming gypsum contaminated with metal, e.g. nickel, which is not acceptable for disposal in a growing number of landfills. Moreover, metal recyclers often prefer to avoid spent electroless nickel solutions because of the high phosphorus content.

U.S. Pat. No. 5,039,497 discloses methods of removing copper from sulfate solutions using aliphatic oximes. Cognis, Inc. (Santa Rosa, Calif.) has disclosed that such an extraction process can be used to treat copper and nickel electroless solutions to reduce the metal content producing a solution suitable for disposal, e.g. by sewering. Such solvent extraction methods have not been enthusiastically adopted for treating plating baths comprising copper complexed with EDTA, in part because common commercial extractants are not especially effective in extracting copper from complexes with EDTA. For instance, copper is effectively extracted from EDTA at a pH in the range of 12–12.5, the same pH used for electroless plating; simultaneous plating and extraction is not desirable. Another disadvantage of the proposed extraction is that, because nickel is invariably associated with cobalt, which irreversibly binds to oximes, the extractant is progressively poisoned.

Cardotte in U.S. Pat. No. 4,985,661 discloses the use of hyperfiltration membranes to process copper electroless plating solutions, e.g. to concentrate for re-use salts of EDTA. Such membranes are more permeable to formaldehyde and formate ions than EDTA salts. It has been found that an undesirably high level of copper salts permeate such membranes both as formate salts and EDTA salts when treating plating bath purge streams. Such copper-containing permeate streams are unsuitable for waste disposal in many places. Moreover, such EDTA-concentrated streams are typically unsuited for recycle without further treatment, e.g. to remove another anions, most commonly sulfate which is present as the principal copper counterion.

An object of this invention is to provide electroless nickel plating baths where the counterions of nickel are selected to allow the advantageous treatment of spent baths and recycle of valuable components.

SUMMARY OF THE INVENTION

This invention provides aqueous electroless nickel plating solutions comprising borane or hypophosphite reducing agents and monovalent anion and/or neutral complexing species that allow selective removal of polyvalent oxidization by-products of the reducing agents using solvent extraction and anion filtration methods.

DETAILED DESCRIPTION OF PREFERRED EMBODIMENT

The electroless nickel plating solutions of this invention comprise water soluble nickel salts of a counterion which is not a polyvalent acid. In one aspect of the invention the nickel is present with a counterion of a monovalent acids such as hypophosphorus acid, nitric acid, acetic acid, sulfamic acid, hydrochloric acid, lactic acid,-formic acid, propionic acid, trichloroacetic acid, trifluoroacetic acid, methanesulfonic acid, glycolic acid, aspartic acid or pyruvic acid or mixtures thereof. Electroless nickel plating solutions also require a chelant for nickel, commonly lactic acid, a monovalent acid, or glycine, a neutral zwitterion. Preferably, the chelant in the solutions of this invention is a neutral zwitterion such as glycine or alanine or monovalent acid such as lactic acid, glutamic acid, pyruvic acid, aspartic acid or glycolic acid or combinations thereof including, depending on the pH of the solution, salts thereof such as alkali metal salts or ammonium salts of the monovalent acids. With regard to pH, the plating solutions of this invention have a pH of 4 to 9, preferably 6 to 8, most preferably about 7. In another aspect of this invention such a chelant is also employed as the principal counterion of nickel. For instance, an acid chelant such as lactic acid can serve the dual purpose of chelant and counterion when nickel lactate is used to prepare or replenish the solution. Similarly, nickel can be electrolytically dissolved in a cell having a cation membrane where nickel cations flow through the membrane into a glycine solution where the zwitterion serves the dual purpose of chelant and counterion.

The plating solutions of this invention comprise a reducing agent for nickel such as hypophosphorus acid, a hypophosphite salt or a borane such as dimethylaminoborane or a borohydride. As metal is reduced, such reducing agents are oxidized to polyvalent anion species. For instance, hypophosphite is oxidized to divalent orthophosphite and boranes are oxidized to polyvalent borates. Monovalent anionic reducing agent comprising hypophosphorus acid or, depending on the pH of the solution, hypophosphite salt is a preferred reducing agent. Another preferred aspect of this invention employs hypophosphite as both the reducing agent and monovalent counterion for nickel. When hypophosphite is employed in the plating baths a preferred molar ratio of nickel ions to hypophosphite ions is between 0.2 and 1.

Stabilizers useful in the plating solutions of this invention, e.g. to retard the tendency of the reducing agent toward promoting unwanted deposition of nickel, include amines such as guanidine, dimethylamine, diethylamine, dimethylaminopropylamine, tris(hydroxymethyl)aminomethane, 3-dimethyamino-1-propane and N-ethyl-1,2-dimethylpropylamine; sulfonic acids such as taurine, 2-hydroxyethanesulfonic acid, cyclohexylaminoethanesulfonic acid, sulfamic acid and methanesulfonic acid; monocarboxylic acids such as acetic acid and propionic acid; and dicarboxylic acids such as succinic acid, maleic acid and tartaric acid. Preferred stabilizers are dimethylamine, dimethylaminopropylamine and 2-hydroxyethanesulfonic acid. Preferably such amines are protonated, i.e. are at a pH less than their pKa in water, more preferably at least 1 pH unit less than their pKa. Unlike the prior art use of volatile free amines, protonated amines are nonvolatile and provide long term stability.

A preferred electroless nickel plating solution of this invention comprises an aqueous nickel solution with a neutral or monovalent counterion such alanine or nitrate, a neutral or monovalent anionic chelant such as glycine or lactate, a neutral or monovalent reducing agent such as a borane or hypophosphite and a stabilizer other than thiourea, e.g. preferably a protonated amine or 2-hydroxyethanesulfonic acid. In such plating solutions hypophosphite is an especially preferred reducing agent. As soluble nickel ions are reduced concurrently with deposition on a surface, the reducing agent is oxidized, e.g. monovalent hypophosphite or neutral borane is oxidized to polyvalent orthophosphite or borate, respectively. As the orthophosphite or borate concentration increases, it is desirable to purge a part volume of the solution, e.g. corresponding to volume of solution comprising replenishing amounts of nickel and reducing agent used to maintain an effective concentration of those constituents in the solution.

In a preferred aspect of this invention spent plating solutions or purge streams from working plating baths are initially treated by solvent extraction to separate and recycle the metal species. Solvent extraction units typically comprise a series of mixing/settling vessels to provide intimate mixing and subsequent separation of an organic liquid and an aqueous liquid. Multi-staged extraction columns with countercurrent flow provide high efficiency liquid extraction. For example, an aqueous liquid comprising a purge stream from such an electroless nickel plating bath or anion filtration unit is intimately mixed with an organic liquid containing a metal-extractant, e.g. a nickel extractant, typically in kerosene. During intimate mixing of aqueous and organic liquids, metal ions cross the phase boundary into the organic solution as a complex with the extractant. When mixing is stopped the phases spontaneously separate, e.g. in an automatic decanter apparatus. When a number of stages of such mixers and decanters are provided in a series, a high degree of efficiency can be attained, providing a nickel ion-depleted aqueous stream and a nickel-extractant organic stream. In summary solvent extraction units typically comprise means for contacting a metal-containing feed stream with an organic solvent solution and means for separating an organic stream containing metal-extractant complex and an aqueous stream depleted in said metal species.

Effective solvent extraction requires the use of an extractant which exhibits a binding energy in a nickel-extractant complex that is greater than the binding energy of nickel ions to the nickel chelant species in the nickel electroless plating bath. The bond strength of common nickel complexes is sufficiently low to allow nickel extraction by common extractants, such as alkylated oximes, beta diketones and hydroxyquinolines. Since such common extractants are readily poisoned by trace contaminants such as cobalt, preferred extractants are hydroxamic acids which are advantageously capable of extracting nickel from chelants with faster mass transfer kinetics and higher loadings, e.g. providing nickel concentrates at about 100 g/l, and without cobalt poisoning. Preferred hydroxamic acids with enhanced hydrolytic stability for cost effective long term use include N-alkyl alkanohydroxamic acids, e.g. N-methyl alkylhydroxamic acids, N-ethyl alkyl hydroxamic acids. Especially preferred are N-ethyl hydroxamic acids disclosed in U.S. patent application Ser. No. 07/890,882. It is generally preferred to reduce the temperature of the solution, e.g. to less than 30° C., to increase stability against autocatalytic deposition of nickel during solvent extraction operations.

In this method of recycling nickel, an organic stream containing nickel-extractant complex is contacted with an acid stream to provide an aqueous stream having dissolved therein the nickel salt of the acid. when it is desired to recycle recovered nickel directly into the plating bath, useful acids include any of the acids corresponding to the monovalent counterions preferred for use in this invention. When the nickel is to be recovered for another use or further processing, other acids, including sulfuric acid, can be employed. Due to inadequate phase separation the aqueous acidic nickel solution can contain trace amounts of organic solvent and extractant which may adversely affect plating baths if the metal-containing solution is recycled to a plating bath. Such trace amounts of organic solvent can be effectively removed by passing the aqueous solution through a phase coalescer, e.g. a glass fiber bed, or an adsorber, e.g. an activated charcoal bed.

Because solvent extraction processes are seldom 100% effective in removing metal, the nickel ion-diminished aqueous raffinate stream from the solvent extraction step may contain sufficient nickel, e.g. as nickel chelant complex, to preclude its direct disposal, e.g. in municipal sewerage treatment facilities. Such residual nickel-chelant complexes can often be removed by reducing the pH of the nickel ion-diminished aqueous stream, e.g. to pH less than 2, to selectively precipitate a nickel hexahydrate chelant species of an amino acid or glycine, which is readily removed by settling, filtration, centrifugation, etc. Removal of such precipitate provides a solution that is more amenable to metal removal by ion-exchange. Trace amounts of nickel, e.g. complexed with a weak chelant, can be removed by conducting the substantially nickel chelant-depleted stream to an ion exchange unit containing a chelating ion exchange resin capable of removing nickel ions from a solution in which nickel ions are complexed with weak chelant, thereby providing an effluent stream essentially depleted of nickel ions and substantially depleted of chelant species.

The preferred plating solutions of this invention comprise hypophosphite, borane or borohydride reducing agents which form polyvalent anionic oxidation by-products. Spent plating baths, purge streams from working plating baths or the metal-reduced raffinate from solvent extraction treatment, contain such polyvalent anionic by-products as well as neutral zwitterionic and/or monovalent anionic counterions, chelants or reducing agents. Depending on their economic value, it is often desirable to separate such counterion, chelant and/or reducing agent from polyvalent by-products, e.g. oxidized reducing agent, or from excess counterion, present in the nickel bath purge stream. The separation of polyvalent anion species from these neutral zwitterion and/or monovalent anion species can be advantageously effected by anion filtration using porous membranes having anionically functionalized surfaces which are more selectively permeable to neutral and monoanionic solutes and less permeable to polyvalent anionic solutes. Such anion filtration can be effected using porous membranes having a negatively-charged, discriminating layer coated onto a porous support layer. Useful membranes include hyperfiltration membranes comprising a sulfonated, polyvinyl alcohol discriminating layer coated onto a porous polysulfone support layer as disclosed in U.S. Pat. No. 4,895,661 which are currently available from Filmtec Corporation, Minneapolis, Minn. Thus, another aspect of this invention provides methods of maintaining effective concentrations of components of plating solutions, or of treating spent plating solutions, by anion filtration treatment to remove polyvalent anions.

To effect anion filtration an electroless plating baths liquid, preferably initially treated by solvent extraction to substantially reduce the metal concentration is conducted to such a membrane filtration unit under sufficient pressure to effect permeation, resulting in a purge stream and a residual stream. The concentration of neutral zwitterions and monovalent anions in the permeate stream and residual stream will be essentially the same as in the feed stream. The concentration of residual nickel ions will follow the chelant concentration. The concentration of the polyvalent anion species, e.g. borate or orthophosphite, will be lower in the permeate stream and higher in the residual stream than in the purge stream. Multi-staged membrane filtration can provide substantial enhancement of separation efficiency. The permeate stream enriched in neutral zwitterions and/or monovalent anions and depleted in polyvalent anions can be recycled to a plating bath directly or after concentration, e.g. where water is removed by reverse osmosis or evaporation.

The residual stream from anion filtration, or optionally the feed stream prior to anion filtration, can be treated by ion exchange to remove residual metal species to provide the residual stream essentially depleted of metal. Such a metal-free stream of polyvalent anion species can be readily disposed. Such ion exchange unit will contain a chelating ion exchange resin adapted to removing nickel ions from solutions in which nickel ions are not too strongly complexed. For instance, nickel complexed with tactic acid is readily extracted using commercial ion exchange resins.

When plating baths contain divalent counterions such as sulfate, the sulfate typically follows the course of the other polyvalent anions. When plating baths contain divalent chelant such as tartrate, the preferred initial treatment is solvent extraction followed by a pH reduction to about 3 to provide a partially protonated monovalent tartrate which can pass through an anion filtration membrane for recycle with other monovalent species. Alternatively, tartrate can be separated from orthophosphite or borate in the residual stream from anion filtration by crystallization using suitable cations such as potassium or ammonium.

While the following examples illustrate the use of various materials in embodiments of plating solutions and methods of this invention, it should be clear from the variety of species illustrated that there is no intention of so limiting the scope of the invention. On the contrary, it is intended that the breadth of the invention illustrated by reference to the following examples will apply to other embodiments which would be obvious to practitioners in the plating arts.

EXAMPLE 1

This example illustrates an electroless nickel plating bath of this invention where hypophosphite anions serve as both the reducing agent and the counterion for nickel. An electroless nickel plating solution was prepared by acidifying an aqueous solution of 14 g/l nickel carbonate with 40 ml/l hypophosphorous acid, followed by the addition of 30 ml/l of lactic acid as chelant, 15 ml/l of acetic acid and 2 ml/l of propionic acid as monocarboxylic acid stabilizers; 15 g/l of sodium hypophosphite monohydrate was added as the reducing agent; the pH was adjusted to 7.2 with ammonium hydroxide and the bath heated to a working temperature of 55° C. A catalyzed fabric, i.e. a piece of nylon ripstop fabric coated with a polymer layer containing palladium as disclosed by Vaughn in U.S. Pat. No. 5,082,734, was immersed in the nickel plating solution for 20 minutes, resulting in a 62% increase in weight due to deposition of a bright adherent nickel coating.

EXAMPLE 2

This example illustrates the utility of protonated amine stabilizers in the electroless nickel plating baths of this invention. A base electroless nickel plating bath was prepared from a nickel solution containing 17.9 g/l nickel sulfate hexahydrate (4 g/l $Ni^{+2}$), 40 ml/l lactic acid, 15 ml/l acetic acid, 3 ml/l propionic acid and 15 g/l sodium hypophosphite monohydrate; the pH was adjusted to 7.2 with ammonium hydroxide. When catalyzed fabric (prepared as in Example 1) was immersed in the base electroless nickel plating bath, heated to a working temperature of 55° C., the bath spontaneously decomposed within thirty minutes.

When catalyzed fabric was immersed in base electroless nickel plating bath, stabilized by the addition of 0.25 mg/l of thiourea (a conventional stabilizer) and heated to a working temperature of 55° C., the bath exhibited good initial stability but decomposed after three hours. Periodic additions of thiourea (about 3 mg/cm$^2$-min) were necessary to maintain stability and prevent spontaneous decomposition.

When catalyzed fabric was immersed in base electroless nickel plating bath, stabilized by the addition of 1.5 g/l of dimethylamine and heated to a working temperature of 55° C., the bath exhibited excellent stability over a four week period. The bath pH was less than the pKa of the dimethylamine, providing non-volatile, protonated amine as the stabilizer.

EXAMPLE 3

This example illustrates the utility of hydroxyalkylsulfonic acid stabilizers in the electroless nickel plating baths of this invention. Base electroless nickel plating bath (according to Example 2) stabilized with 10 g/l of 2-hydroxyethanesulfonic acid (isethionic acid) and heated to a working temperature of 55° C. exhibited excellent stability during plating of nickel onto catalyzed fabric (according to Example 1) for over 24 hours.

A similar bath stabilized with 10 g/l of 2-hydroxyethanesulfonic acid and heated to a working temperature of 90° C. exhibited excellent stability during plating of nickel onto low carbon steel for over 5 hours.

EXAMPLE 4

This example illustrates an electroless nickel plating baths of this invention comprising a dimethylaminoborane reducing agent. An electroless nickel plating bath was prepared containing 20 g/l nickel sulfate hexahydrate, 20 g/l Rochelle salts (sodium-potassium-tartrate), 20 g/l glycine and 1 g/l dimethylaminoborane; the pH was adjusted to 7.0 with ammonium hydroxide. Catalyzed fabric (prepared as in Example 1) immersed in the electroless nickel plating bath, heated to working temperatures of 55° and 80° C., was coated with bright nickel; the bath was stable and did not spontaneously decompose.

EXAMPLE 5

This example illustrates an electroless nickel plating baths of this invention comprising monovalent anions. An electroless nickel plating bath was prepared comprising 4 g/l $Ni^{+2}$, from nickel sulfamate, 40 ml/l lactic acid, 10 ml/l acetic acid, 10 ml/l propionic acid and 1.5 g/l dimethylamine hydrochloride; the pH was adjusted to 7.2 with ammonium hydroxide. Catalyzed fabric (prepared as in Example 1) immersed in the electroless nickel plating bath, heated to a working temperature of 60° C., was coated with bright, adherent, low phosphorus nickel.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. An aqueous electroless nickel plating solution comprising a water soluble nickel salt associated with neutral zwitterionic counterion, monovalent anionic counterion, a chelant, or a mixture thereof; a monovalent or neutral reducing agent for nickel, and a stabilizer selected from the group consisting of protonated amine or hydroxyalkanesulfonic acid.

2. A solution according to claim 1 wherein said monovalent anionic species is derived from hypophosphorus acid, nitric acid, acetic acid, sulfamic acid, hydrochloric acid, lactic acid, formic acid, propionic acid, trichloroacetic acid, trifluoroacetic acid, methanesulfonic acid, glycolic acid, aspartic acid, pyruvic acid or a mixtures thereof and said neutral zwitterion is glycine or alanine.

3. A solution according to claim 1 wherein said chelant is lactic acid, glutamic acid, pyruvic acid, aspartic acid, glycolic acid, a salt of any such acid, glycine, alanine or a mixture thereof.

4. A solution according to claim 1 wherein said reducing agent is a hypophosphite, borane or borohydride.

5. A solution according to claim 4 wherein said reducing agent is hypophosphite in the molar ratio of nickel to hypophosphite ions of 0.2 to 1.

6. A solution according to claim 1 having a pH of 4 to 9.

7. A solution according to claim 6 having a pH of 6 to 8.

8. A solution according to claim 1 wherein said protonated amine stabilizer is dimethylamine or dimethylaminopropylamine and said hydroxyalkanesulfonic acid is 2-hydroxyethanesulfonic acid.

9. A solution according to claim 2 wherein said protonated amine stabilizer is dimethylamine or dimethylaminopropylamine and said hydroxyalkanesulfonic acid is 2-hydroxyethanesulfonic acid.

10. A solution according to claim 3 wherein said protonated amine stabilizer is dimethylamine or dimethylaminopropylamine and said hydroxyalkanesulfonic acid is 2-hydroxyethanesulfonic acid.

11. A solution according to claim 5 wherein said protonated amine stabilizer is dimethylamine or dimethylaminopropylamine and said hydroxyalkanesulfonic acid is 2-hydroxyethanesulfonic acid.

12. A solution according to claim 6 wherein said protonated amine stabilizer is dimethylamine or dimethylaminopropylamine and said hydroxyalkanesulfonic acid is 2-hydroxyethanesulfonic acid.

13. A solution according to claim 7 wherein said protonated amine stabilizer is dimethylamine or dimethylaminopropylamine and said hydroxyalkanesulfonic acid is 2-hydroxyethanesulfonic acid.

* * * * *